US005701348A

United States Patent [19]

Shennib et al.

[11] Patent Number: 5,701,348

[45] Date of Patent: Dec. 23, 1997

[54] ARTICULATED HEARING DEVICE

[75] Inventors: Adnan Shennib, Fremont; Richard Urso, Redwood City, both of Calif.

[73] Assignee: Decibel Instruments, Inc., Hayward, Calif.

[21] Appl. No.: 365,913

[22] Filed: Dec. 29, 1994

[51] Int. Cl.[6] ..... H04R 25/00

[52] U.S. Cl. ..... 381/68.6; 381/69

[58] Field of Search ..... 381/68.6, 68, 68.3, 381/69, 69.2; 181/135, 130

[56] References Cited

U.S. PATENT DOCUMENTS

| | | | |
|---|---|---|---|
| Re. 26,258 | 8/1967 | Martin | 381/68.6 |
| 3,061,689 | 10/1962 | McCarrell et al. | 381/68.6 |
| 3,414,685 | 12/1968 | Geib et al. | 381/68.6 |
| 3,527,901 | 9/1970 | Geib | 381/68.6 |
| 4,539,440 | 9/1985 | Sciarra | 179/107 |
| 4,870,688 | 9/1989 | Voroba et al. | 381/60 |
| 4,937,876 | 6/1990 | Biermans | 381/68.6 |
| 5,031,219 | 7/1991 | Ward et al. | 381/68.6 |
| 5,185,802 | 2/1993 | Stanton | 381/68.6 |
| 5,201,007 | 4/1993 | Ward et al. | 381/68.6 |
| 5,201,008 | 4/1993 | Arndt et al. | 381/68.6 |
| 5,390,254 | 2/1995 | Adelman | 381/68 |

FOREIGN PATENT DOCUMENTS 2203379 10/1988 United Kingdom .

OTHER PUBLICATIONS

Gudmundsen, Gail I., "Fitting CIC Hearing Aids—Some Practical Problems", The Hearing Journal, Jul. 1994, pp. 10, 45–48.

Agnew, Jeremy PhD, "Acoustic advantages of deep canal hearing aid fittings", Hearing Instruments, vol. 13, No. 6, 1992, pp. 22–25.

Oliveira, Robert J., PhD et al., "A Look at Ear Canal Changes with Jaw Motion", Ear and Hearing, vol. 13, No. 6, 1992, pp. 464–466.

Staab, Wayne J. et al., "Taking Ear Impressions For Deep Canal Hearing Aid Fittings", The earing Journal, vol. 47, No. 11, Nov. 1994.

"Special Product Guide" for Completely-in-the-Canal Hearing Instruments (CICs), The Hearing Journal, vol. 47, No. 11, Nov. 1994, pp. 56–57.

"Mini-canal hearing instruments in review", Hearing Instruments, vol. 40, No. 1, 1989, pp. 30–52.

"E-Z Ear" specifications, General Hearing Instruments, Inc., New Orleans, LA.

Oliveira, Robert J., PhD, "Better hearing instruments through chemistry", Technological Report, reprinted from Hearing Instruments, vol. 39, No. 10, 1988.

Bryant, Margaret P. et al., "Minimal contact long canal ITE hearing instruments", Hearing Instruments, vol. 41, No. 1, 1991.

*Primary Examiner*—Curtis Kuntz
*Assistant Examiner*—Vivian Chang
*Attorney, Agent, or Firm*—Michael A. Glenn

[57] ABSTRACT

A hearing device having highly articulated, non-contiguous parts and adapted for placement within the ear canal includes a receiver module for delivering acoustic signals within close proximity to the tympanic membrane, a main module containing all hearing aid components except the receiver, and a connector that routes amplified electrical signals from the main module to the receiver module. The connector fits in the cartilaginous area of the ear canal and is articulated with both the receiver module and main module to permit independent movement of the receiver module and main module while the hearing device is inserted or removed and during various jaw movements, such as chewing, yawning, and talking. The connector may be an adjustable shaft that accommodates various canal lengths and that allows incremental receiver placement depths within the ear canal. The receiver module, which is inserted deeply, preferably in the bony portion of the ear canal to provide all of the advantages associated with deep receiver placement, incorporates various sealing means to substantially reduce acoustic leakage that causes oscillatory feedback.

46 Claims, 14 Drawing Sheets

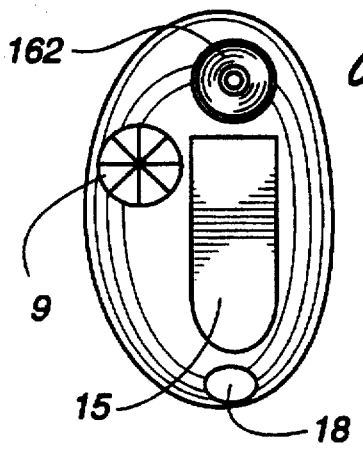
Fig. 6a
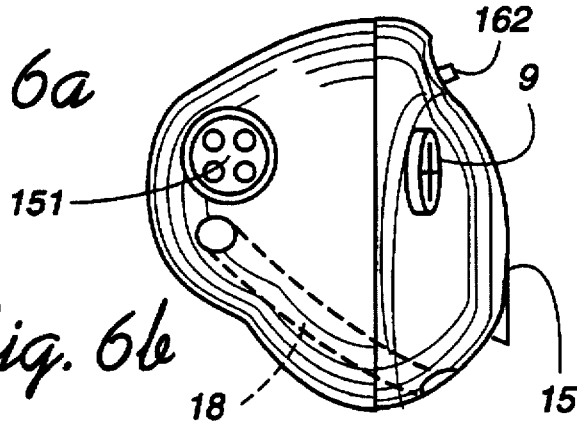
Fig. 6b
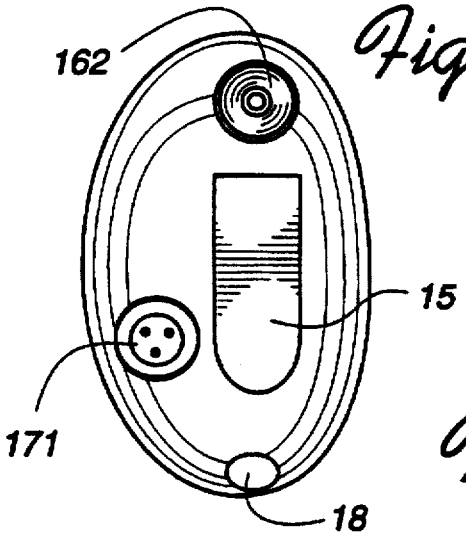
Fig. 7a
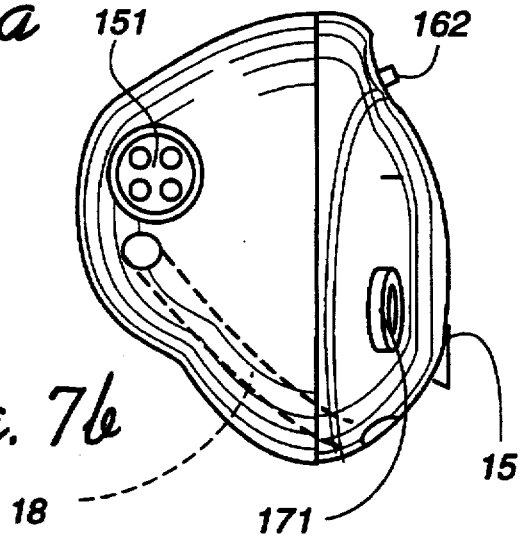
Fig. 7b
Fig. 8a
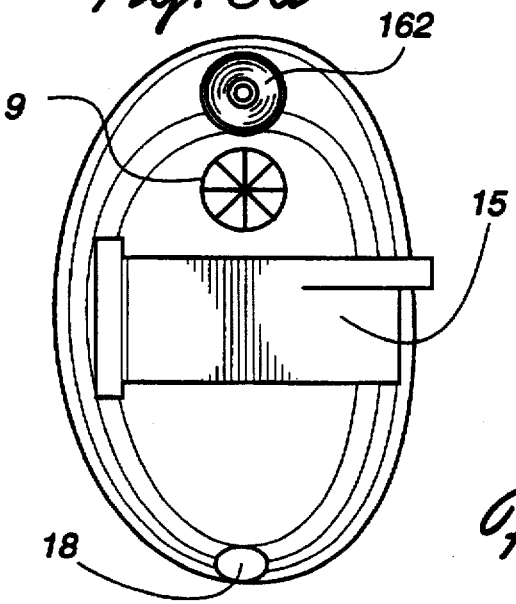
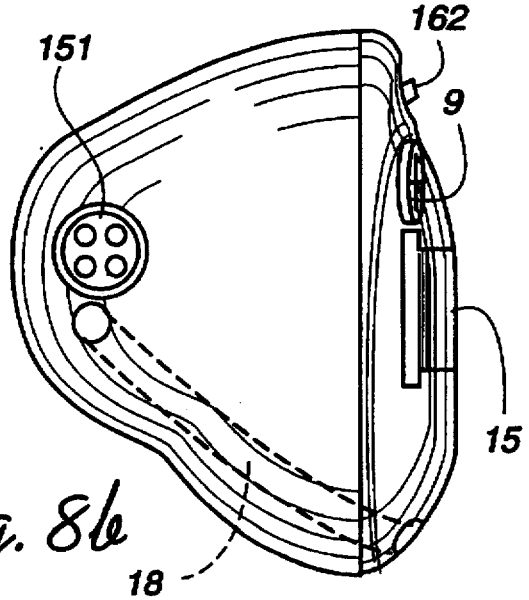
Fig. 8b

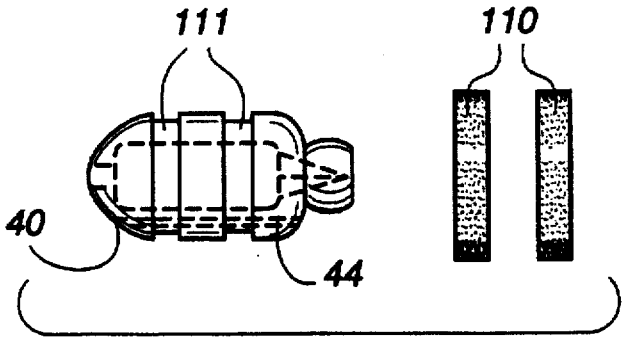
Fig. 15
Fig. 16b Fig. 16d
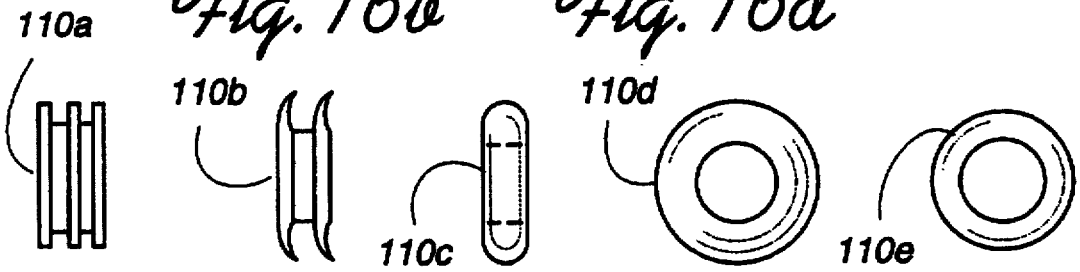
Fig. 16a Fig. 16c Fig. 16e
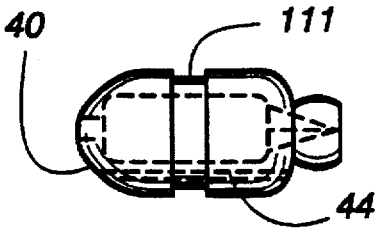
Fig. 17
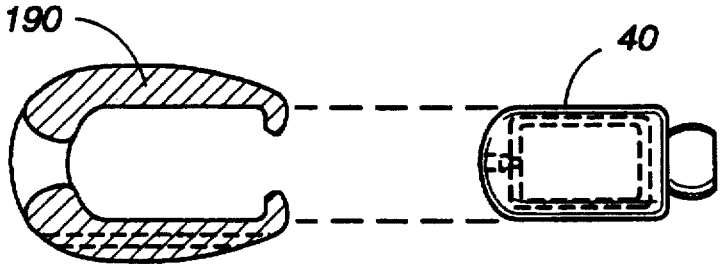
Fig. 18

ARTICULATED HEARING DEVICE

BACKGROUND OF THE INVENTION

1. Technical Field

The invention relates to hearing aids. More particularly, the invention relates to hearing devices that can be easily and deeply inserted in the ear canal, while accommodating deformations of the ear canal to provide a comfortable fit.

2. Description of the Prior Art

The trend in the design and manufacture of hearing devices has generally been towards miniaturization as device components and energy sources continue to decrease in size and improve in efficiency. This trend is largely fueled by the demand for a more inconspicuous and cosmetically appealing devices to avoid the stigma of aging and disability associated with hearing impairment.

Two decades ago, hearing devices were predominately of the Behind-The-Ear (BTE) type. These devices are placed behind the ear with an acoustic tube connecting the device to an ear mold placed within the ear. Today, smaller In-The-Ear (ITE) type devices which essentially fit within the concha of the ear, represent the largest segment of hearing aid types used. Smaller In-The-Canal (ITC) types, which fit partially in the concha and partially within the ear canal, have also become increasingly popular in recent years. In concert with this miniaturization trend, smaller hearing aid devices that fit completely within the ear canal, known as Completely-In-the-Canal (CIC), are now offered on the market.

In addition to the obvious cosmetic advantages of miniature hearing devices, e.g. ITC and CIC types, there are several other advantages that result from device placement within the ear canal. These advantages include improved high frequency response, reduced distortion, reduced occlusion effect, improved sound localization, reduced wind noise, fewer wax problems that typically plug the device receiver, improved use with telephones, and improved overall sound fidelity due to reduced residual volume in the ear canal and proximity of the hearing device receiver to the tympanic membrane (for example, see Gudmundsen, G. I., *Fitting "CIC" Hearing Aids- Some Practical Pointers,* The Hearing Journal, vol. 47, No. 7, 1994, pp. 10, 45–48; and Agnew, J., *Acoustic Advantages of Deep Canal Hearing Aid Fittings,* Hearing Instruments. Vol. 45, No. 8, 1994, pp. 22–25).

Anatomy and Morphology of the Ear Canal

FIGS. 1 and 2 show a cross-sectional anatomical view of the ear in the coronal and transverse planes of the head, respectively. The ear, for the purpose of this invention, can be described as having three segments. The first segment represent the medial concha cavity 20 just behind the tragus 21 which is relatively large and is surrounded by cartilaginous tissue 22. The second cavity 23, medial to the aperture 24 of the external acoustic meatus 11, is generally smaller and is also surrounded by cartilaginous tissue 22. The third cavity 25 defines the final canal segment near the tympanic membrane 26 and is surrounded by dense bony tissue 27. The tissue covering the cartilaginous regions 28 is relatively thick and has a well developed subcutaneous layer thus allowing some expansion to occur. In contrast, the tissue covering the bony region 29 is relatively thin and therefore, little or no tolerance for expansion exists in this region. The cartilaginous region 23 is the major area of cerumen production and accumulation in the ear canal.

The shape of a typical external ear canal, unlike that shown in most artistic renderings, is rarely cylindrical or conical with a gradual narrowing towards the tympanic membrane. Instead, most ear canals are non-uniform and have various levels of tortuous contours. Some canals have severe restrictions in the cartilaginous area.

The ear canal is generally S-shaped, with a first bend 30 occurring approximately at the aperture of the ear canal and a second bend 31 occurring at the cartilaginous-bony junction. The cross sectional diameter of the ear canal and the orientation of various regions within the canal are known to vary considerably from one individual to another. For example, the length from the aperture 24 to the lateral edge 32 of tympanic membrane 26 ranges from about 20 mm to about 25 mm. The cross sectional shape is generally oval. The smallest diameter is generally in the bony region 29 in the transverse plane and ranges from about 4 mm to about 7 mm. The largest diameter is in the medial concha region 20 in the coronal plane and ranges from about 10 mm to about 18 mm.

The morphology of the ear canal reveals substantial deformation within the cartilaginous area 23 of the ear canal as a result of mandibular motion associated with talking, chewing, yawning, and biting. This deformation is generally caused by the asymmetric stresses from the actions of the mandibular condyle 33 (see FIG. 2) on neighboring cartilaginous tissue. These deformations have radial components, e.g. constrictions, and axial components, i.e. inward and outward motion. These radial and axial deformations can generally be felt when one inserts a finger in the ear canal and moves the jaw. In one study, using magnetic resonance imaging (MRI), the deformation was shown to be as much as 25% in the anterior-posterior direction of the cartilaginous region of the canal (see, for example Oliveira, R. J., Hammer, B., Stillman, A., Holm, J., Jons, C., Margolis, R. H., *A Look at Ear Canal Changes with Jaw Motion,* Ear and Hearing, Vol. 13, No. 6, 1992, pp. 464–466).

The unique and tortuous nature of individual ear canals, in combination with the dynamic canal deformations due to mandibular motion, present unsolved challenges to users of current hearing aid designs, particularly for deep canal devices. These problems include difficulty in device insertion and removal, discomfort, device retention, and oscillatory feedback. These problems are further aggravated for persons who suffer abnormal mandibular function leading to severe ear canal deformations, as in the case of temporal mandibular joint (TMJ) syndrome.

The State of the Art

The substantial inter-subject variability of ear canal shapes has lead the hearing aid industry to develop hearing devices that are custom manufactured, based on individual ear canal impressions sent to the manufacturer by the dispensing professional. These custom devices require an accurate impression to fabricate hearing devices that precisely conform to the shape of the ear canal. This custom fit attempts to minimize discomfort to the patient and possible damage to the patient's ear tissue and to prevent feedback-causing acoustic leakage (see, for example Staab, W. J., Martin, L. R., *Taking Ear Impressions for Deep Canal Hearing Aid Fittings,* The Hearing Journal, Vol. 47, No. 11, 1994, pp. 19–28).

Previews of available miniature devices (see, for example *Special Report: Completely-In-The-Canal Hearing Instruments,* The Hearing Journal, Vol. 47, No. 11, 1994, pp. 56–57; and *Mini-Canal Hearing Instruments In Review,* Hearing Instruments, Vol. 40, No. 1, 1989, pp. 30–36, 52) reveal an assortment of hearing devices that require individualized ear impressions and custom manufacturing. These custom hearing devices are generally made of rigid or semi-rigid acrylic material. Although they may conform to the shape of the ear canal when they are fully inserted, they present insertion and removal difficulties, particularly for individuals having tortuous canals and canals that have non-gradual narrowing.

Non-custom hearing devices, e.g. stock hearing aids that do not require individual ear canal impressions or custom manufacturing, have been also available on the market. For example, the E-Z EAR hearing device manufactured by General Instruments, Inc., New Orleans, La. is a stock hearing device that is marketed as a loaner or a back-up device, because a precise fit of a custom device is considered important for patient comfort and feedback considerations with current hearing aid designs.

Another stock hearing device is described by Veroba et al (see U.S. Pat. No. 4,870,688), in which a rigid core module containing electronic components is combined with a malleable covering module. The modules are selected from an off-the-shelf assortment to personalize the device fit. Even though the covering is malleable, the core module is rigid and the combined structure has a contiguous housing that has only limited ability to conform to various non-uniform ear canal shapes of a broad population. This is especially true for hearing devices that are deeply inserted in ear canals that are typically S-shaped.

Another attempt to resolve the problem of conforming a hearing device to the unique shapes of individual ear canals is disclosed in Oliveira, R. J., *Better Hearing Instruments Through Chemistry*, Hearing Instruments, Vol. 39, No. 10, 1988. Oliveira proposed attaching a compressible foam ear mold to the acoustic output of ITE and ITC hearing aids containing a receiver via a threaded coupler. The foam ear mold contains a semi-rigid tubing that prevents the foam from fully collapsing and occluding the sound intended for delivery to the tympanic membrane. The overall length of the device and the fixed relationship between the foam ear mold and the hearing device renders this solution impractical for dealing with various ear canal shapes and sizes, particularly for deep ear canal device insertion.

Sciarra, M. (see U.S. Pat. No. 4,539,440) describes an ITC hearing device having a generally cylindrical body with a resilient stretchable outer layer that is adjustable to expand and change the diameter of the device. The device is adjustably expandable such that it fits snugly within the ear canal and is flexibly hinged to permit axial flexibility to accommodate the curvature of the ear canal. However, Sciarra fails to teach how an essentially cylindrical shaped device conforms to ear canals that are generally non-uniform or that are S-shaped.

Biermans, J. (see U.S. Pat. No. 4,937,876) describes a hearing device that consists of two units. The first unit has a larger cross section and contains typical hearing aid components, except for the receiver. The second unit has a smaller diameter and contains the receiver. The two units, which may either be contiguous or separated, are encapsulated by a contiguous housing, presumably of standard rigid or semi-rigid acrylic material.

Painter, D. S. et al (see UK patent No. GB 2 203 379 A) describes a non-custom hearing device that initially contains a flexible membrane housing. The device is inserted into the ear canal and a curable material is injected into the flexible housing, causing the device to harden while conforming to the shape of the ear canal. Arndt, H. (see U.S. Pat. No. 5,201,008) describes a modular hearing device having a housing that includes a hinged face-plate. The housing contains modular electronic and receiver components. The housing, e.g. hearing aid shell, may be custom or stock. Stanton, M. (see U.S. Pat. No. 5,185,802) describes a modular hearing device having a removable universal interior module that fits within an exterior shell which is customized for right or left ear canals.

The above mentioned designs of miniature hearing devices, e.g. ITC and CIC, whether fully custom manufactured or stock manufactured for off-the-shelf dispensing, modular or non-modular, having rigid, semi-rigid, or malleable housing, do not deal effectively with typical ear canal deformations that are due to various jaw movements. These dynamic deformations in the cartilaginous area lead to many undesirable effects that are known in the hearing aid industry, including poor device retention due to axial pressures on the device, discomfort, pain, and acoustic oscillatory feedback.

Ward, L. W. et al (see U.S. Pat. Nos. 5,201,007 and 5,031,219) describes a hearing aid having a rigid acoustic conduction tube that conducts sounds to the tympanic membrane. The acoustic conduction tube has an external diameter that is smaller than the ear canal and a flexible flanged tip that seals near the tympanic membrane. This concept, which is known as minimal contact technology (MCT), alleviates some of the stresses caused by ear canal deformation via the narrow sound conduction tubing which is in minimal contact with the tissue that is subject to deformation. The practical implementation of this concept is described for BTE and ITE types, for example, by Bryant, M. Mueller, H. G., Northern, J. L., *Minimal Contact Long Canal "ITE" Hearing Instruments*, Hearing Instruments, Vol. 42, No. 1, 1991, pp. 12–15, 48. However, the applicability of the MCT concept is questionable for conventional miniature hearing device designs, e.g. ITC or CIC. Such hearing devices have a contiguous rigid or semi-rigid housing, and may not be comfortably and deeply inserted into a narrow and tortuous ear canal.

SUMMARY OF THE INVENTION

The invention provides a hearing device that incorporates all of the known advantages of miniature hearing aids that are deeply inserted in the ear canal with new designs that greatly facilitate device insertion and removal, while also providing a hearing device having comfortable fit, and reduced oscillatory feedback during normal and abnormal ear canal deformation.

The invention provides a hearing device having non-contiguous parts that are highly articulated within the ear canal. The device primarily consists of three main modules:

(1) A receiver module that delivers acoustic signals within close proximity of the tympanic membrane;

(2) A main module essentially containing typical hearing aid components, except the receiver; and (3) A connector that routes the amplified electrical signals from the main module to the receiver module.

The connector fits in the cartilaginous area of the ear canal and is articulated with both the receiver and main modules to accommodate essentially independent movement of the receiver and main modules when the hearing device is inserted or removed, and during various jaw movements such as chewing, yawning, and talking. The connector may be an adjustable shaft to accommodate various ear canal lengths and to allow for incremental receiver depths within the ear canal.

The receiver module is inserted deeply into the ear canal, preferably in the bony portion of the ear canal, to provide all of the advantages associated with deep receiver placement. These advantages include improved energy efficiency and high frequency response, reduced oscillatory feedback, reduced occlusion effect, reduced distortion, and reduced perceived noise. The receiver module includes various seals that substantially reduce acoustic leakage that can cause oscillatory feedback. Furthermore, because the receiver module is completely encapsulated and essentially isolated from the microphone in the main module, internal acoustic leakage that can cause oscillatory feedback is also reduced.

In the preferred embodiment of the invention, the main module is loosely fitted in the medial concha area just behind the tragus. The hearing device is generally invisible unless viewed directly from the side of the ear. The main module can be highly vented with minimal concerns for oscillatory feedback. This venting allows occluded own-sounds, i.e. sounds that originate with the individual wearing the device, resonating in the cartilaginous cavity to leak out of the hearing aid, instead of propagating to the tympanic membrane, as is the case in conventional hearing aids which have a single contiguous enclosure.

In the preferred embodiment of the invention, the receiver module may connect to any of an assortment of acoustic seal tips to accommodate variability in ear canal diameters and shapes. The unique features of the invention, for example articulated parts, adjustable connector length, and assorted acoustic seal tips, provide a universal hearing device that can be dispensed at the point of sale without the need for ear canal impressions or custom manufacturing.

BRIEF DESCRIPTION OF THE DRAWINGS

FIGS. 6*a* and 6*b* show a pediatric size main module housing in accordance with the invention;

FIGS. 7*a* and 7*b* show an adult size main module housing in accordance with the invention;

FIGS. 8*a* and 8*b* show a large size main module housing in accordance with the invention;

FIG. 15 is a side view of a receiver module having multiple grooves and sealing rings in accordance with the invention;

FIGS. 16*a*–16*e* are side views of alternative sealing rings for use with the receiver modules of FIGS. 15 and 17 in accordance with the invention;

FIG. 17 is a side view of a receiver module having a single groove in accordance with the invention;

FIG. 18 is a sectioned view of a receiver module having a sleeve seal in accordance with the invention;

DETAILED DESCRIPTION OF THE INVENTION

The hearing device described herein is used for hearing enhancement and auditory rehabilitation of hearing impaired individuals. The hearing device is also adapted for use as an Intra-Canal-Prosthesis (ICP) in conjunction with a Virtual Electroacoustic Audiometer (VEA), both of which are described in U.S. patent application Ser. Nos. 08/292,072, 08/292,067 and 08/292,073, all of which were filed on Aug. 17, 1994.

Figure 1:
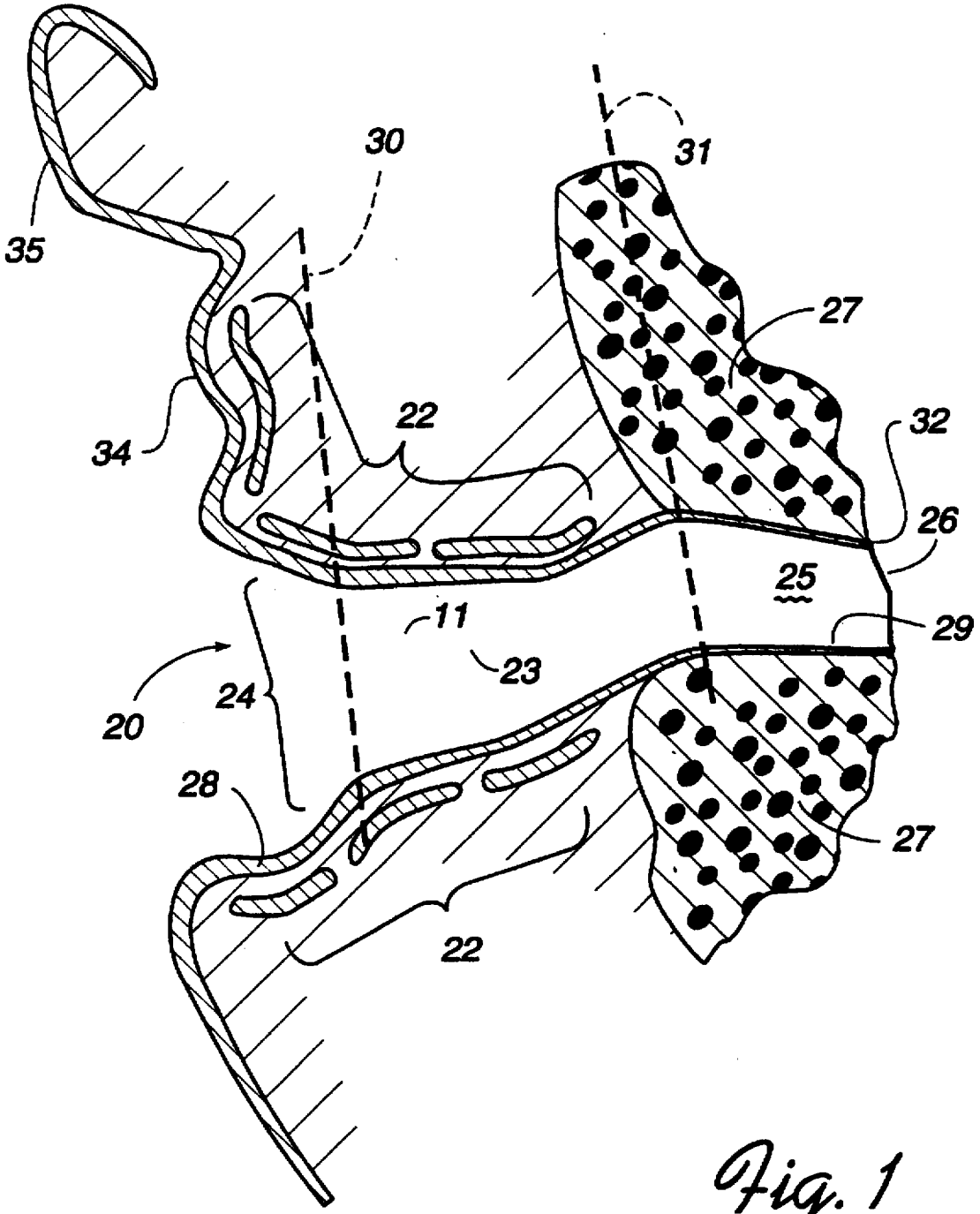
FIG. 1 is an anatomical view of a right ear in the coronal plane.
Figure 2:
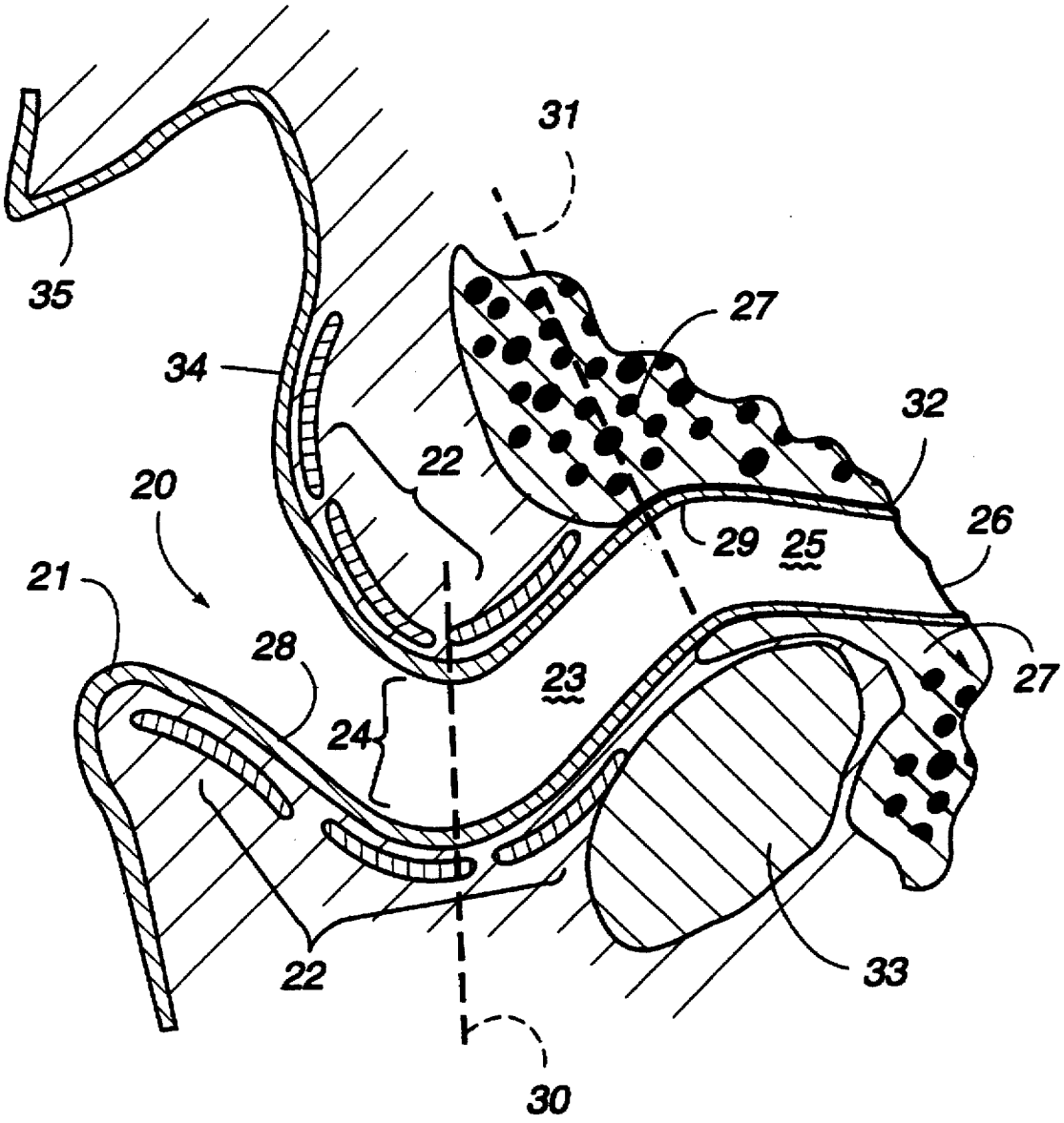
FIG. 2 is an anatomical view of a right ear in the transverse plane.
Figure 3:
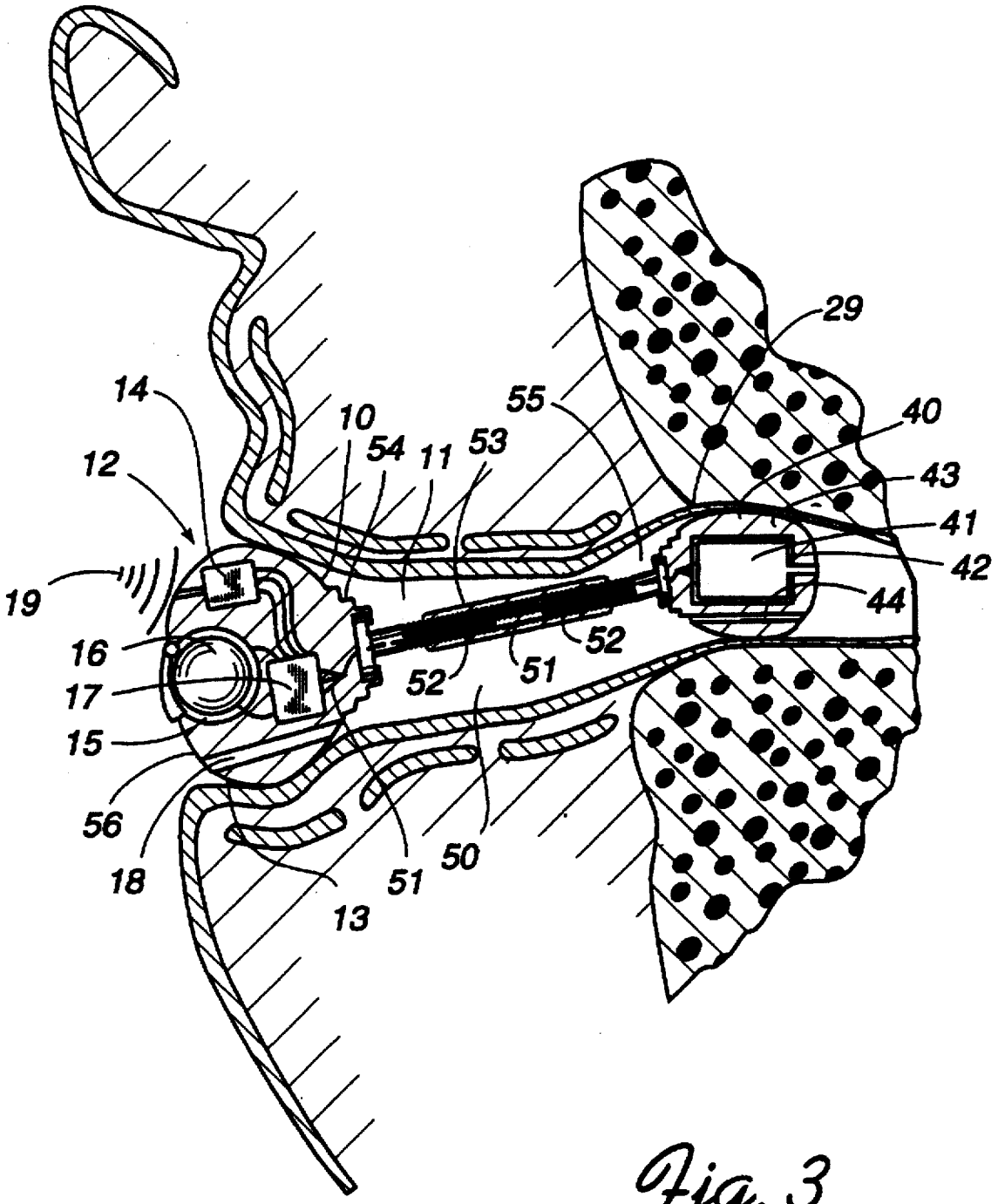
FIG. 3 is a coronal plane view of a right ear showing an articulated hearing device in accordance with the invention.
Figure 4:
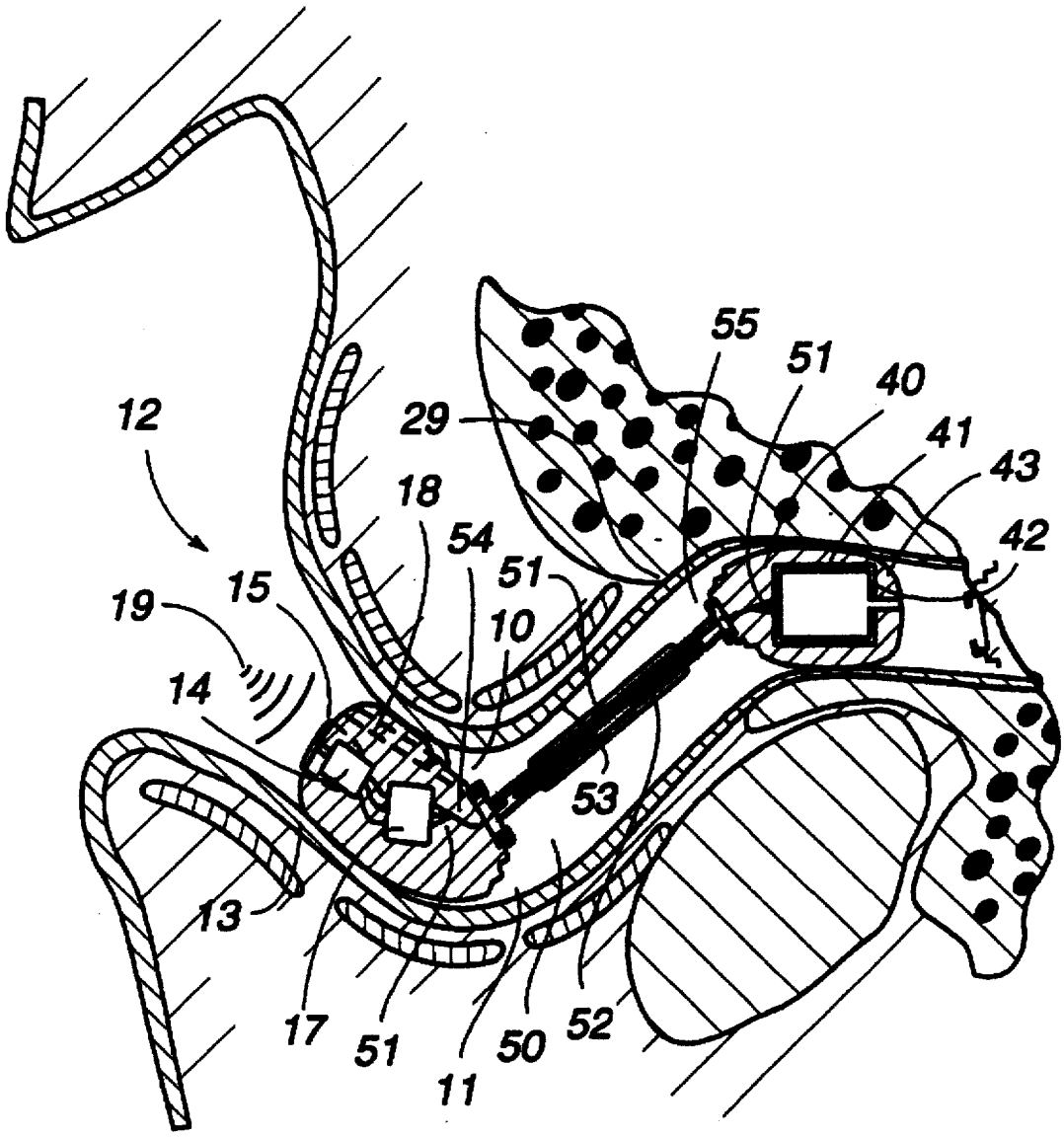
FIG. 4 is a transverse plane view of a right ear showing an articulated hearing device in accordance with the invention.

FIGS. 3 and 4 show coronal and transverse views, respectively, of the major components of the preferred embodiment of the herein disclosed hearing device 10 inserted in the right ear canal 11.

The main module 12 includes all of the typical components found in a hearing devices, except for the receiver. These components include a housing 13, a battery compartment 15, a battery 16, a relatively large vent 18, a signal processor circuit 17 such as the miniature high fidelity non-programmable hybrid ER101-28D manufactured by Etymotic Research of Elk Grove Village, Ill., and a low noise microphone 14 such as the EM4068 manufactured by Knowles Electronics of Itasca, Ill.

The receiver module 40 includes a receiver 41, a rigid housing 42, and an external housing made of a soft and malleable material 43. The receiver 40 is deeply positioned within the ear canal, preferably in the bony portion 29 of the canal. The receiver module acoustically seals the device in the bony area as shown in FIGS. 3 and 4. A small vent 44 within the receiver 40 acts primarily as a pressure relief vent.

A connector 50 contains electrical wires 51 that carry electrical signals representing processed acoustic signals 19. The connector in the preferred embodiment of the invention contains hollow screw shafts 52 that are articulated with the main module 12 via a tapered boot 54, and with the receiver module 40 via another tapered boot 55. The length of the connector shaft is adjustable via the adjusting screw sleeve 53 to accommodate variability in ear canal lengths.

Separation of the receiver from the main module, and the receiver's articulation with respect to the main module, allows the receiver to have at least two degrees of freedom in movement. This freedom of movement allows essentially independent movement of the receiver module with respect to the main module, and vice versa. The articulation facilitates deep device insertion and removal, particularly in narrow and tortuous ear canals. The articulation is also important for accommodating various normal and abnormal ear canal deformations.

Figure 5:
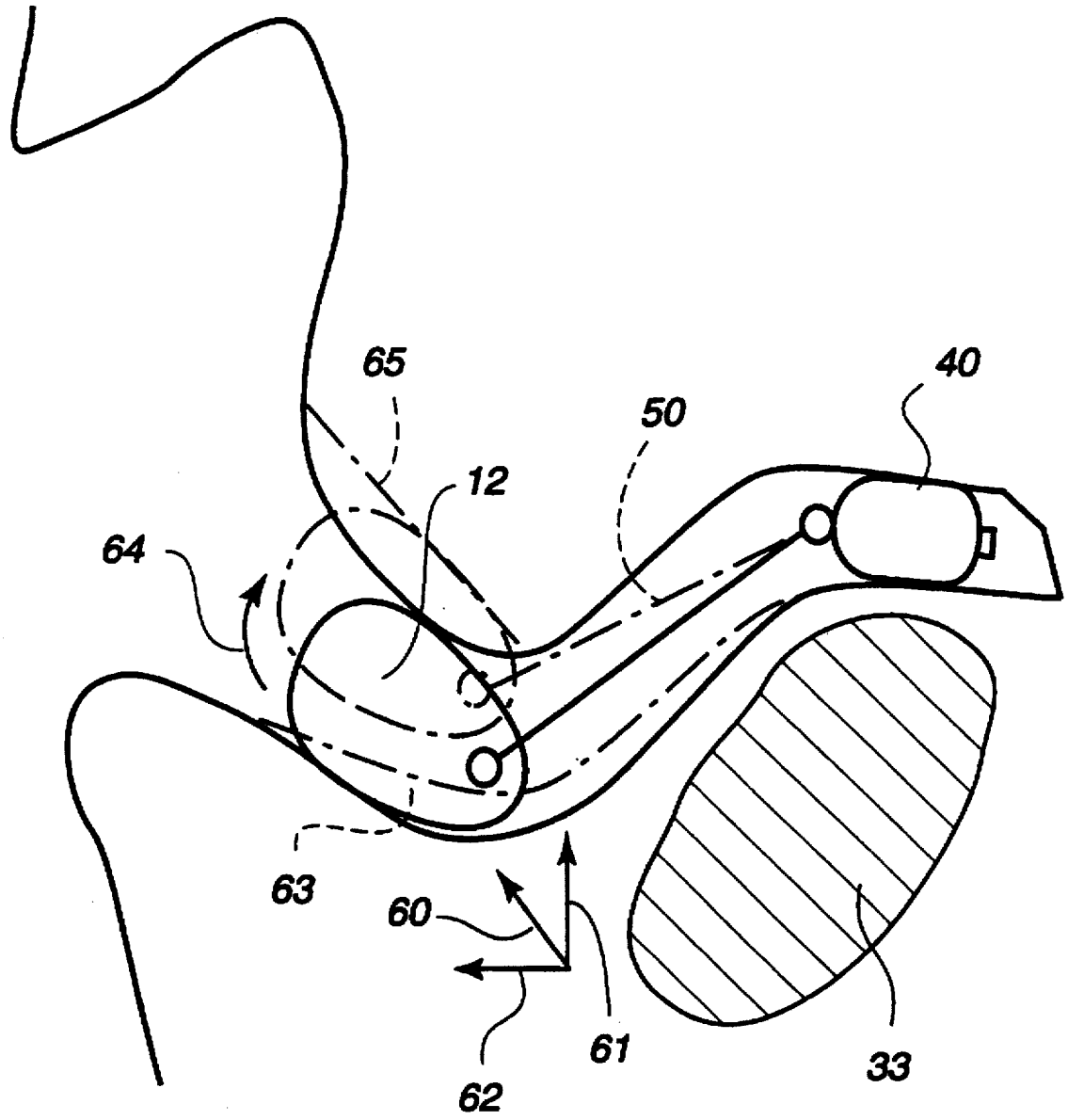
FIG. 5 is a view of an articulated hearing device showing response to radial and axial deformations in the transverse plane in accordance with the invention.

FIG. 5 shows the articulated device as it responds to a particular mandibular pressure from the condyle 33. This pressure is represented by a vector 60 having a radial component 61 and an axial component 62. Ear canal deformations that are due to direct mandibular pressure are shown by the dashed line 63. The articulated hearing device, particularly at the main module 12 and at the connector 50, shifts in response to the mandibular pressure and causes a secondary ear canal deformation, as shown by the dotted line 65.

Radial pressure generally has minimal effect on the device because the diameter of the connector 50 is smaller than the diameter of the ear canal, as shown in the figure. Axial pressure which is generally smaller, causes the main 12 module, and subsequently the connector 50, to move and rotate in the direction of the arrow 64, as is shown in the figure. These device movements have minimal effect on the articulated receiver module 40, thus allowing the receiver module to maintain an acoustic seal with the ear canal, such that the device is comfortable to wear during various mandibular motions. This combination of comfort and continuous acoustic sealing during mandibular motion is not possible with conventional hearing aid designs that employ contiguous housings and non-articulated parts.

Another advantage of the invention is improved retention of the device within the ear canal. This is due to the essentially independent movement of device parts in response to various mandibular motions.

By positioning the receiver in the articulated receiver module, instead of in the main module as in conventional designs, substantial reduction in the size of the main module is realized. Typical receivers for use with this invention include the ES series manufactured by Knowles Electronics which are 7.5 min. long, 3.58 mm high, and 3 mm wide. The OV series receiver, also manufactured by Knowles, is slightly larger but its oval shape better conforms to the natural shape of a typical ear canal. The size reduction due to repositioning the receiver away from the main module is significant because it allows a smaller main module to fit deeper in the medial concha area 20, which is generally more uniform than the lateral concha area 34.

Single or multiple controls 9, e.g. miniature trimmers (see FIGS. 6–8) are typically needed for the non-programmable hearing device and are typically positioned on the face-plate side 56 of the hearing device. For programmable hearing devices, a programmable signal processor circuit 17, such as the ER-102, also manufactured by Etymotic Research, may be used. This arrangement requires a miniature electrical connector (not shown) on the face plate, such as the CS44-01 manufactured by Microtronic of Rosklide, Denmark.

Other variations of component distribution within the hearing device are possible without departing from the principles of the invention. For example, many receivers, such as the ES series mentioned above, contain an integrated electronic circuit that is used for signal amplification. It is likely that in the future additional circuits or even the entire signal processing circuit may be fully integrated within the receiver.

FIGS. 6–8 show detailed dimensions of a pediatric, adult, and large size main module housing, respectively, in accordance with various embodiments of the invention. The size of the main module in the example embodiments shown in FIGS. 6–8 is largely determined by the battery size. A pediatric-size device, designed primarily for children, uses battery sizes 5A and 10A; the adult-size main module uses 10A or 312A battery; and a large-size main module, designed for large ears or for individuals having severely impaired hearing, requires larger batteries of higher energy capacity, such as battery sizes 312A and 13.

The main module contains a relatively large vent 18 that presents minimal impedance to own-sounds, versus the higher impedance smaller vent 44 of the receiver module 40. This venting arrangement prevents leakage of own-sounds into the tympanic membrane. The large vent of the main module, or venting via loosely inserted device, also improves air circulation to the tissue in the cartilaginous area. The unique design of the articulated hearing device herein disclosed provides a highly vented device, without such concerns for oscillatory feedback as are common to conventional hearing devices having a contiguous housing.

FIGS. 6–8 show typical dimensions of housings in the preferred embodiment for pediatric (FIGS. **6*a* and 6*b*), adult (FIGS. 7*a* and 7*b*), and large (FIGS. 8*a* and 8*b***) main modules. These designs were developed from averaged ear canal impressions taken of twelve adults and two children, including six pairs of complete impressions taken from adult cadavers. The principal criteria for the main module design is that it should fit deeply and comfortably within the medial concha of most individuals, although an exact match of the main module to the shape of each ear canal is not required.

Figure 9A:
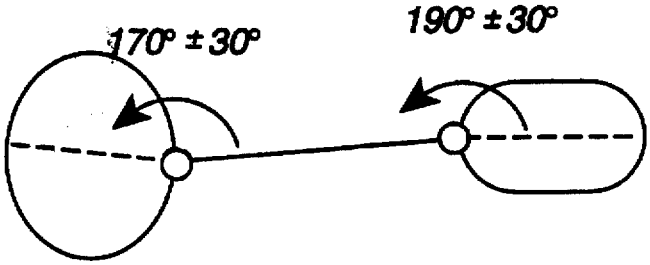
FIGS. 9*a* and 9*b* provide coronal and transverse views, respectively, of articulated device modules showing module articulation and general dimensions in accordance with the invention.
Figure 9B:
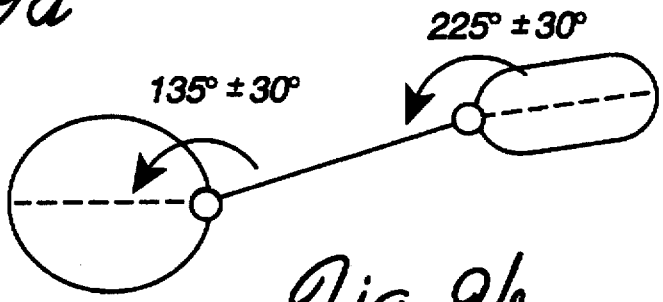

FIGS. **9*a* and 9*b* show the preferred articulation angle, range of articulation, and range of dimensions for the preferred embodiment of the invention in the coronal (FIG. 9*a*) and transverse (FIG. 9*b***) views. The diameters of the main module are approximately 15 mm and 9.5 mm in the coronal and transverse planes, respectively. The articulation of the main module with the connector is nominally at angles of about 170° and about 135° in the coronal and transverse planes, respectively, with an additional range of articulation of approximately 30°. The length of the connector is approximately 5 mm +/−3 mm. The receiver articulates with the connector approximately with nominal angles of about 190° and about 225° in the coronal and transverse planes, respectively. An additional range of articulation of approximately 30° is preferred. The length of the receiver module is approximately 6.5 mm +/−2 mm with diameters of 4.5 mm and 3.5 mm in the coronal plane and transverse plane, respectively.

Figure 10:
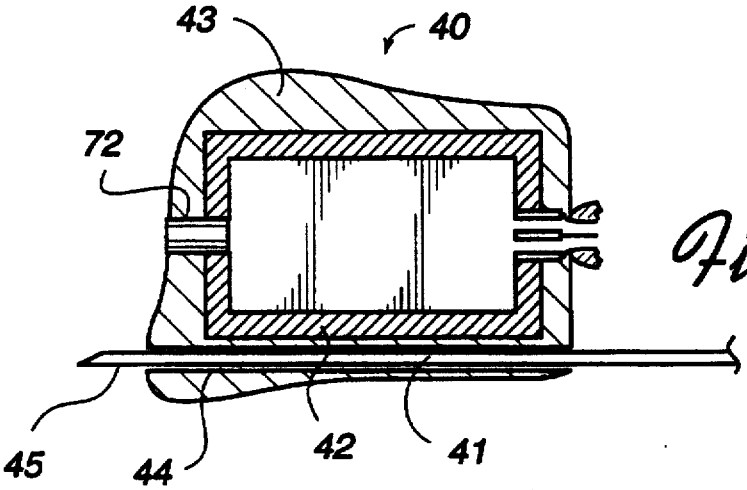
FIG. 10 is a sectioned view of a receiver module having a built-in soft and compliant housing in accordance with the invention.
Figure 11:
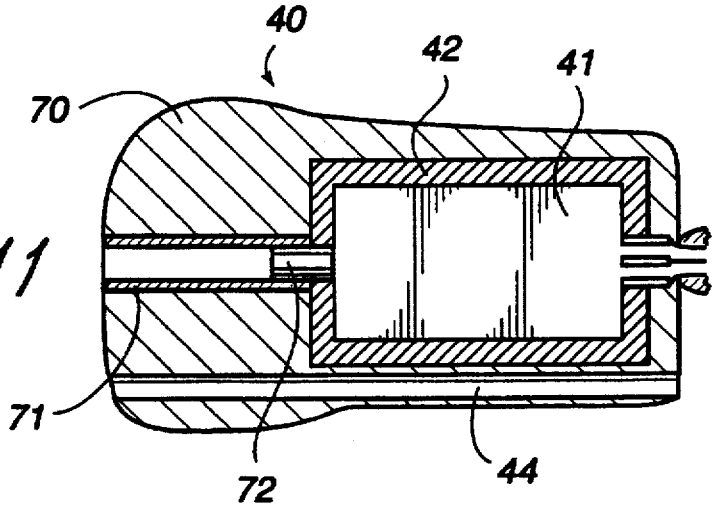
FIG. 11 is a sectioned view of a receiver module having a built-in bulbous tip of soft and compliant material in accordance with the invention.
Figure 12:
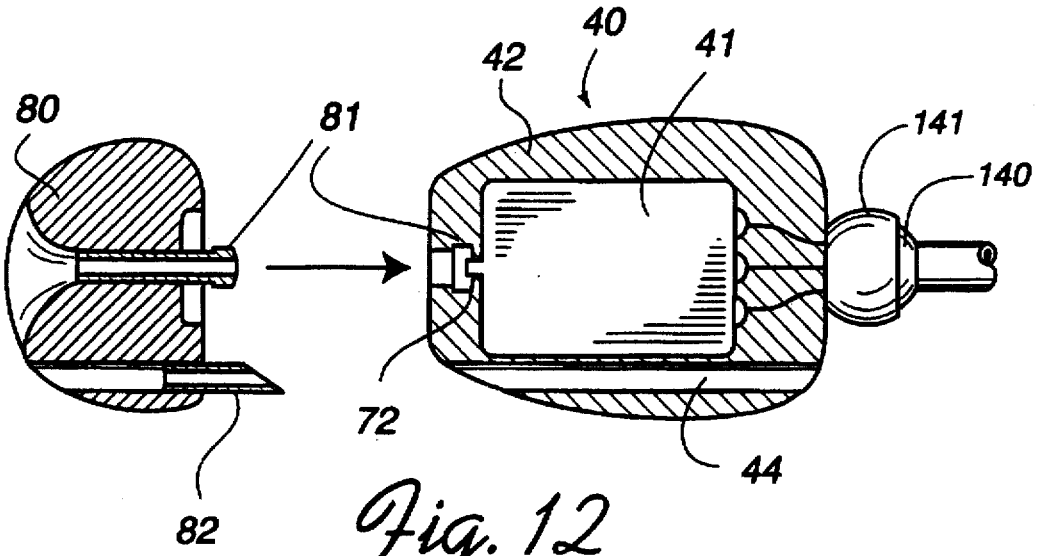
FIG. 12 is a sectioned view of a receiver module adapted to connect to a snap-on soft tip in accordance with the invention.
Figure 13:
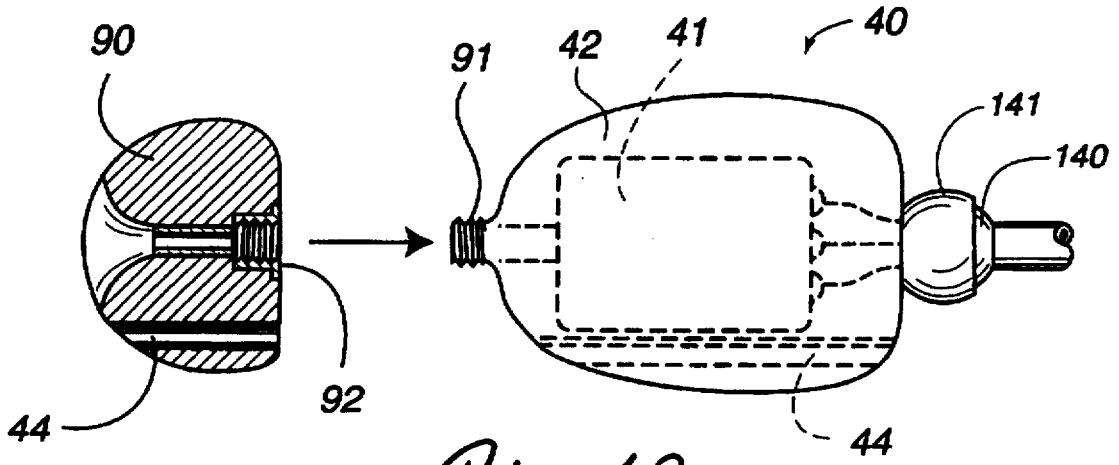
FIG. 13 is a sectioned view of a receiver module adapted to connect to a sealing tip via a threaded screw in accordance with the invention.
Figure 14:
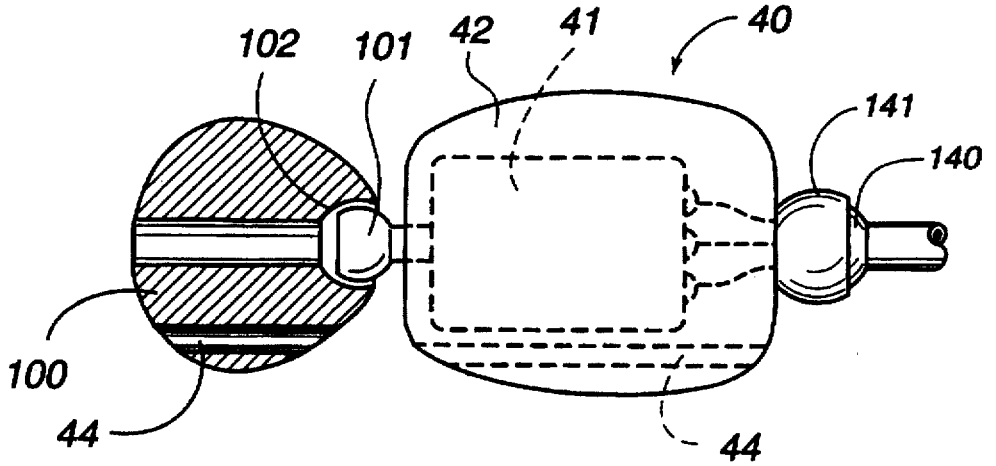
FIG. 14 is a sectioned view of a receiver module having an articulated sealing tip in accordance with the invention.

The invention incorporates several design options that reduce or eliminate various causes of oscillatory feedback, including:

1. Reduction of Feedback Due To Independent Motion of Main Modules. As described above, the independent motion of the articulated hearing device modules prevents oscillatory feedback due to acoustic leakage conventionally caused by various ear canal deformations. This oscillatory feedback occurs when the microphone of the hearing device receives some of the acoustic energy that is produced by the receiver.
2. Reduction of Feedback Due To External Acoustic Leakage. External leakage due to imprecise device fit also represents a common cause of oscillatory feedback. In addition to the basic principles of the articulated hearing device relating to feedback reduction, the following represent additional features of the invention that reduce external acoustic leakage feedback:
   a. A receiver module 40 having a built-in compliant sealing housing 43, as shown in FIG. 10, made of a soft material such as medical grade silicone. The pressure vent 44 may also be used for inserting a probe tube 45 into the ear canal during real-ear and VEA measurements.
   b. A receiver module 40 having a built-in sealing bulbous tip 70, as shown in FIG. 11, also made of a soft compliant material such as medical grade silicone. A semi-rigid tubing 71 prevents the tip 70 from fully collapsing and occluding the sound from the receiver port 72.
   c. A receiver module 40, as shown in FIG. 12, that is adapted to connect to a snap-on sealing tip 80, which is made of a soft material such as silicone or foam. The connection to the receiver port 72 is made via snap-on connectors 81. Orientation of the sealing tip 80 with the receiver 41 for probe tube insertion is assured via an alignment insert 82.
   d. A receiver module 40, as shown in FIG. 13, that is adapted to connect via threaded connections 91, 92 to a sealing tip 90, which is made of a soft material such as silicone or foam.
   e. A receiver module 40, as shown in FIG. 14, that is adapted to connect to an articulated tip 100, which is made of a soft material such as silicone or foam. The articulation is provided via a ball joint 101 and a ball socket 102.
   f. A receiver module 40, as shown in FIGS. 15 and 17, that is adapted to connect to multiple or single sealing rings 110, respectively, on multiple or single grooves 111, respectively, on the surface of a receiver 40. The rings are made of a soft compliant material such as silicone or foam. The rings 110*a*–110*e* may have various diameters and/or profiles as desired (see, for example FIGS. 16*a*–16*e*).
   g. A receiver module 40, as shown in FIG. 18, having a sleeve seal 190 that is made of a soft compliant material such as silicone or foam.

The separable sealing parts, described above, are preferably washable or disposable.

3. Reduction of Feedback Due To Internal Acoustic Leakage. Another type of oscillatory feedback is caused by acoustic leakage that is conducted internally from the receiver to the microphone of conventional hearing devices. The invention substantially reduces this type of feedback because the receiver is completely encapsulated and is essentially isolated from the internal components of the main module, particularly the microphone.
4. Reduction of Feedback Due To Shell Vibrations. Another type of feedback that is substantially reduced by the invention is feedback caused by receiver vibration that is conducted to the microphone via the contiguous rigid shell used in conventional hearing aids. The articulated hearing device consists of separated parts, therefore, there is no contiguous surface to conduct receiver vibration.
5. Reduction of Feedback Due To Piston Action of High Sound Pressures. This type of feedback, common in hearing devices having very high acoustic gains in excess of 50 dB, is referred to as the piston action feedback. Such feedback is caused by high sound pressure levels that are produced in the ear canal that cause the entire hearing device to vibrate. Sound waves are externally generated from the vibrating face-plate of the hearing device. When reflective surfaces such as telephone receivers or hands are placed near the vibrating hearing device, these sound waves can bounce back into the microphone of the hearing device and cause oscillatory feedback. The invention substantially decouples the movements of the receiver from the main module, thus reducing piston action feedback common to conventional hearing aids that have a contiguous housing. Furthermore, the viscoelastic material incorporated into the connector, as is described in greater detail below, further reduces piston action feedback.

The receiver module 40 is preferably inserted in the bony region 29 of the ear canal to maximize the electroacoustic benefits associated with close receiver proximity to the tympanic membrane. For persons having extreme tissue sensitivity, the receiver may be placed in the deeper portion of the cartilaginous region 23 of the ear canal, preferably at the junction of the cartilaginous-bony areas. The depth of receiver insertion may be adjusted using an adjustable length connector. The receiver module 40 may also be incrementally positioned deeper in the ear canal, via the adjustable connector, as the individual gradually adapts to the receiver.

Figure 19:
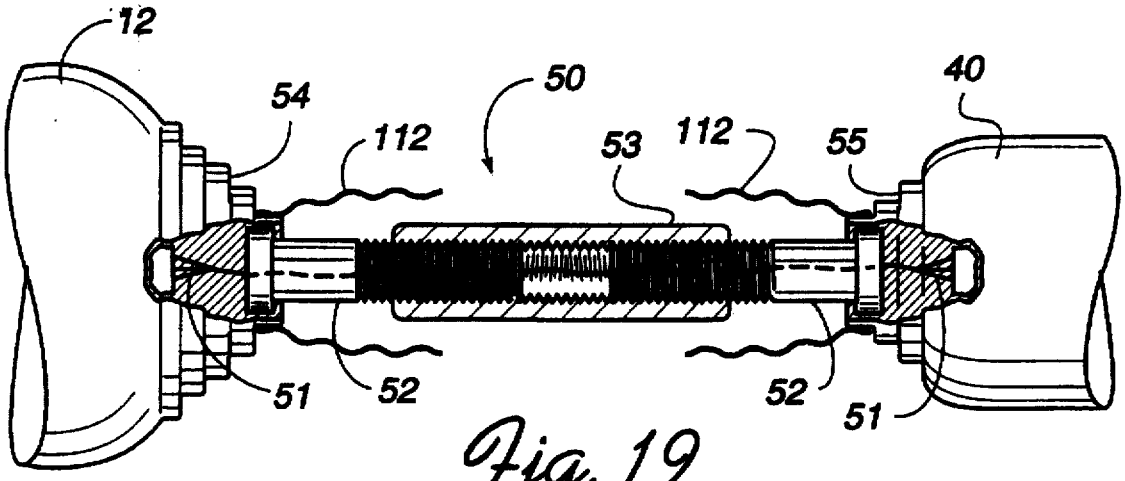
FIG. 19 is a sectioned view of an adjustable shaft connector using hollow screws and a screw sleeve in accordance with the invention.

An example of an adjustable connector 50 is a turnbuckle shaft having an adjusting screw sleeve 53, as is shown in FIG. 19. The threads of one of the shafts are reversed to allow for connector 50 expansion or contraction via the rotation of the adjusting screw sleeve 53, which also has reversed threads on one of its sides A sheath 112 encapsulates the connector to protect against dirt and physiological byproducts, e.g. sweat and cerumen.

Figure 20:
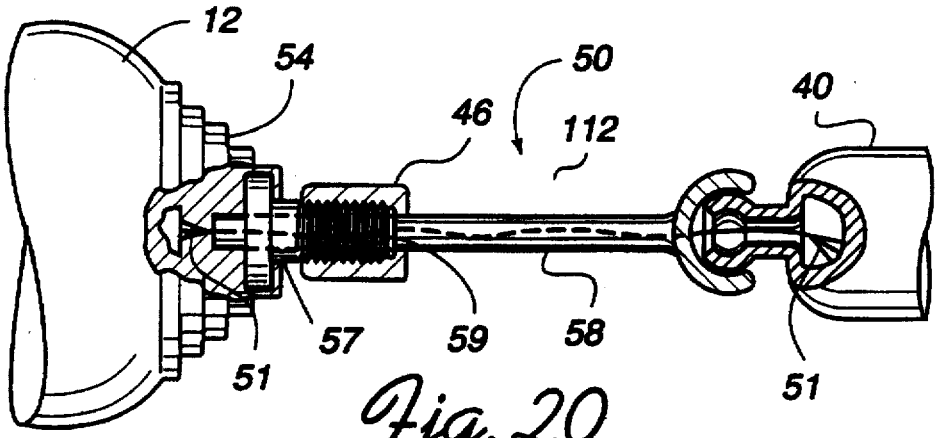
FIG. 20 is a sectioned view of an adjustable connector using a telescopic shaft having a compression nut in accordance with the invention.

Another variation of the adjustable connector is the telescopic shaft shown in FIG. 20, where a compression nut 46 and a compression ring 59 are used to secure a long shaft 58 to a short screw shaft 57, according to the desired length of the connector. Other methods of connector adjustment are possible and will be obvious to persons skilled in the art of miniature mechanics.

Figure 21:
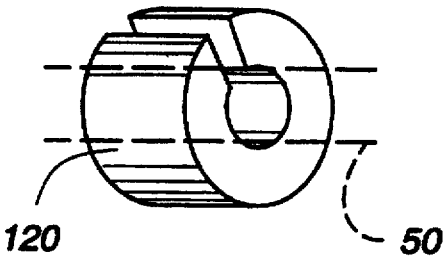
FIG. 21 is a perspective view of a compressible cylinder around a connector in accordance with the invention.

In the invention, the connector 50 diameter is less than the diameter of the ear canal in the cartilaginous area to accommodate various ear canal deformations. The connector may also incorporate a compressible cylinder 120, as shown in FIG. 21 to reduce further the possibility of external acoustic leakage that causes oscillatory feedback. The cylinder is preferably disposable and made of a foam material, such as E.A.R., manufactured by Cobot Safety Corporation of Indianapolis, Ind., or Comply, manufactured by Hearing Components, Inc. of Maplewood, Minn. In addition to acoustic sealing in the cartilaginous area, the cylinder facilitates cerumen collection because it is positioned in the primary area of cerumen production. This arrangement prevents cerumen accumulation in the ear canal, a problem common to many hearing aid users, particularly the elderly.

Figure 22:
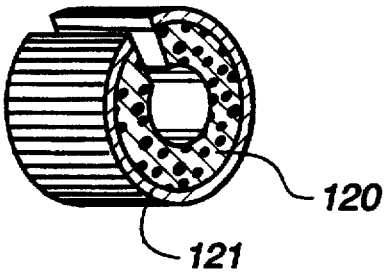
FIG. 22 is a partially sectioned, perspective view of a compressible cylinder having a cloth surface in accordance with the invention.

Another variation of the cylinder around the connector, shown in FIG. 22, incorporates a cloth surface 121 on the cylinder 120 to facilitate cerumen collection. The cloth is preferably made of a soft, non-abrasive, biocompatible material such as cotton.

Figure 23:
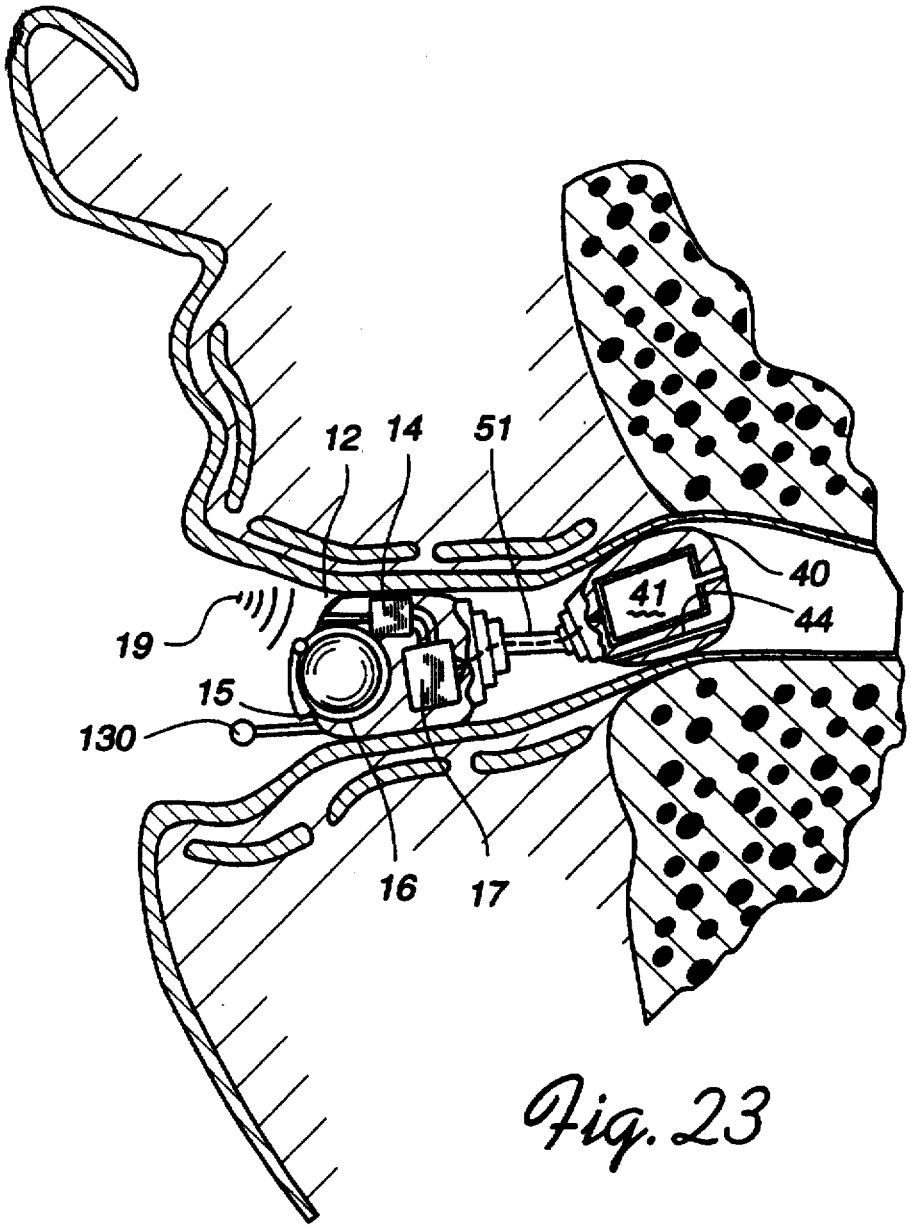
FIG. 23 is a coronal view of a completely-in-the-ear-canal configuration of an articulated hearing device in accordance with the invention.

The main module 12 may also be inserted deeper in the ear canal beyond the canal aperture 24 and within the cartilaginous area 28, as is shown in FIG. 23. In this completely-in-the-canal (CIC) configuration, the main module is preferably loosely fitted in the cartilaginous area of the ear canal. An extraction line 130, typically made of nylon, facilitates the removal of the articulated device. The CIC configuration is suitable for persons having relatively good manual dexterity, who prefer a highly inconspicuous hearing device having maximum cosmetic appeal. The deep-concha configuration, shown in FIGS. 3 and 4, which is also inconspicuous, is especially suitable for persons having relatively poor manual dexterity.

Both the CIC and the deep concha hearing device configurations, FIGS. 23 and 3, respectively, are designed to take advantage of the natural acoustic features of the concha 34 and pinna 35 areas of the ear. These benefits include selective frequency amplification and sound localization.

Figure 24:
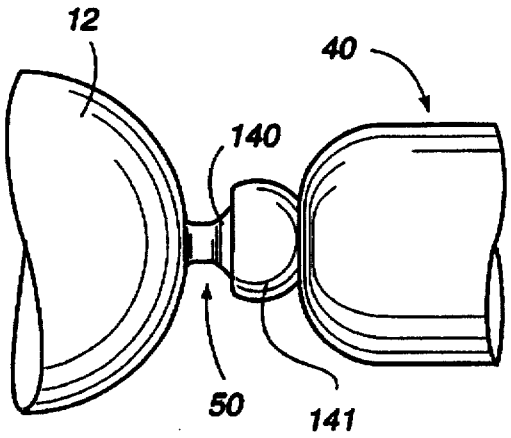
FIG. 24 shows single ball-joint articulation with a short connector in accordance with the invention.

The articulation for the hearing device of the invention is achieved by a variety of means. FIG. 24 shows a single articulation between the main module 12 and the receiver module 40, with a short connector 50. The articulation consists of a ball-joint mechanism having a ball 140 and a ball socket 141.

Figure 25:
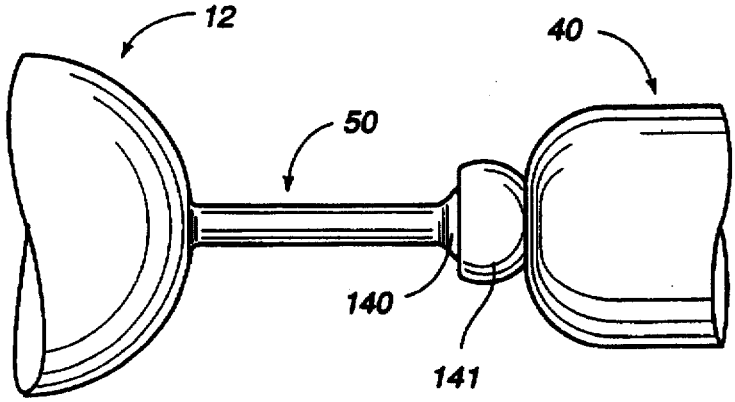
FIG. 25 shows single ball-joint articulation with a long connector in accordance with the invention.

FIG. 25 shows a single articulation at the receiver module 40 with a long connector 50. The ball-joint articulation consists of a ball 140 and a ball socket 141.

Figure 26:
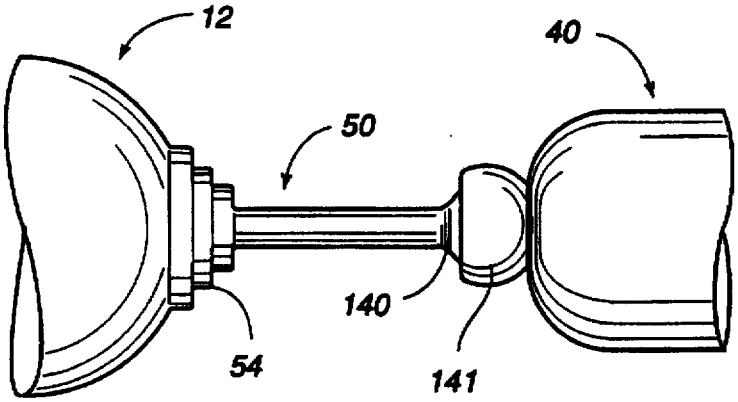
FIG. 26 shows double articulation with a tapered boot and a ball joint in accordance with the invention.

FIG. 26 shows double articulations at each end of the connector 50. The articulation consists of a ball 140 and a ball socket 141 at the receiver module end of the connector, and a tapered boot 54 at the main module end of the connector. The boot 54, or the connector in general, may incorporate a viscoelastic material to isolate mechanical vibration among the device parts.

Figure 27:
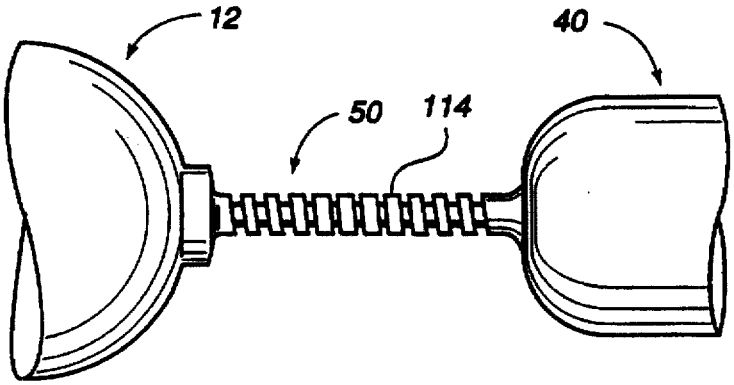
FIG. 27 shows a continuous articulation connector in accordance with the invention.

The articulation may also be obtained via a flexible connector 40, as is shown in FIG. 27. The flexible shaft shown provides continuous articulation across the connector part. The grooves 114 may be patterned, as shown, to provide more articulation at receiver module 40 and main module 12 ends of the connector, as compared with a relatively more rigid central part of the connector 50.

Figure 28:
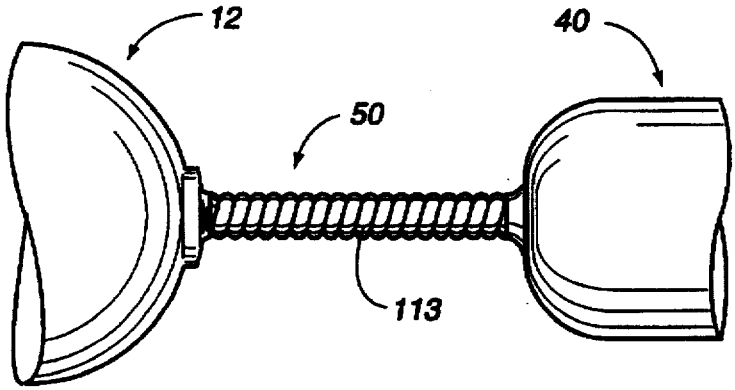
FIG. 28 shows a spring coil connector in accordance with the invention.

The articulation may be also obtained via a spring coil 113 connector, as is shown in FIG. 28. The spring coil connector is preferably made of stainless steel, where the outside coil diameter is in the range of about 1.5 mm to about 3 mm, and where wire diameter is in the range of about 0.15 mm to about 0.3 mm. The pitch of the coil is preferably tight, with a tensile strength in the range of about 250 to about 340 pounds per square inch.

Other embodiments of the invention that provide articulation at the receiver module, main module, or connector are possible and will be obvious to persons skilled in the art of micro-mechanics and materials.

The preferred embodiment of the invention is a universal hearing device that does not require custom manufacturing or the taking of individual ear canal impressions. The main module is designed to be loosely fitted, and generally fills the relatively compliant outer portions of the ear canal. The receiver module provides wearing comfort by articulating when it is inserted and removed, and during various ear canal deformations. The receiver module seals individual ear canals of various sizes and shapes via its malleable housing, or via one of the various acoustic seals discussed above. The sealing tips are preferably assorted to allow for customization of the device at the dispensing site. The assorted sizes of main modules also allow for a broad physical fitting range, including children, adults, persons having large ears, and persons who are severely hearing impaired.

In another embodiment of the invention, the device may be custom manufactured according to an ear impression or any other method where the details of the ear canal can be measured or described. Alternatively, the device may be partially custom manufactured. For example, the receiver module or the main module may be fabricated according to a partial impression of the ear canal representing the part to be customized.

Figure 29:
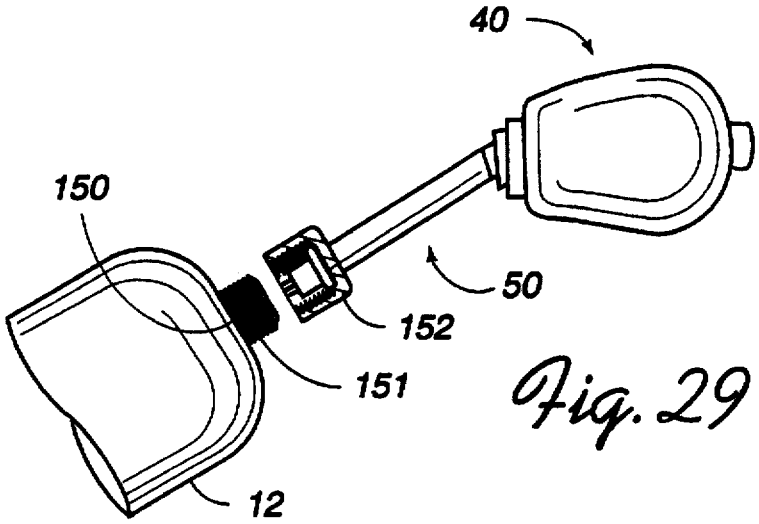
FIG. 29 shows a modular articulated hearing device having detachable parts in accordance with the invention.

In another embodiment of the invention, the parts of the hearing device are modular, detachable, and interchangeable for in-office customization and assembly. FIG. 29 shows a modular hearing aid having an articulated receiver module and a connector that is detachable from a three-pin connector 150 via a coupler screw 151 and a coupling nut 152. Other detachable areas, not shown, may include the center of the connector, the receiver-connector junction, and other areas that will be obvious to persons skilled in the art.

Figure 30:
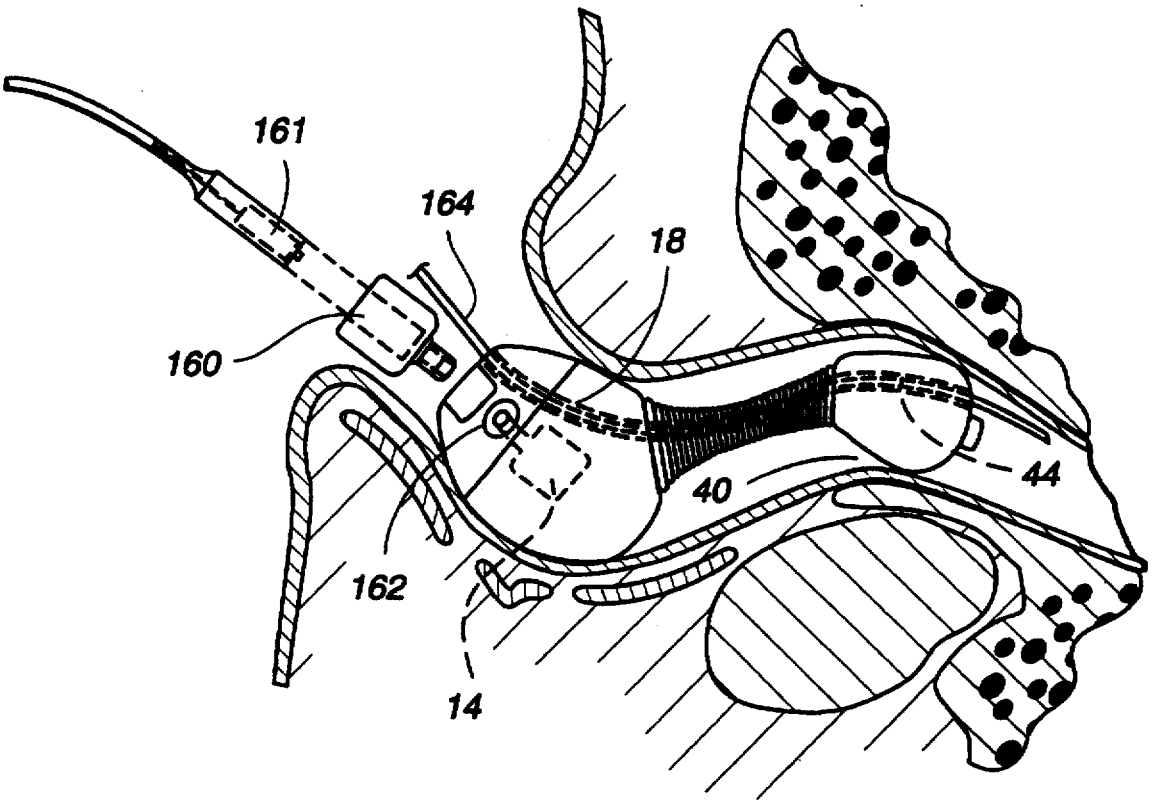
FIG. 30 shows an articulated hearing device microphone adapted to receive direct acoustic input from a virtual electroacoustic audiometer in accordance with the invention.

The microphone of the articulated hearing device may be adapted to receive direct acoustic signals from a virtual electroacoustic audiometer, such as disclosed in U.S. patent application Ser. Nos. 08/292,072 and 08/292,073, referenced above. As shown in FIG. 30, the microphone 14 is connected to a microphone port 162 that connects to a receiver 161 via an acoustic coupler 160. The receiver 161 is connected to the virtual electroacoustic audiometer (not shown) which presents acoustic signals directly to the articulated hearing device for aided hearing evaluation. A probe tube 164 is inserted via a main module vent 18 and a receiver vent 44, as is shown in FIG. 30. The probe tube is used to measure the acoustic response in the ear canal near the tympanic membrane from signals generated via the receiver 40.

Figure 31:
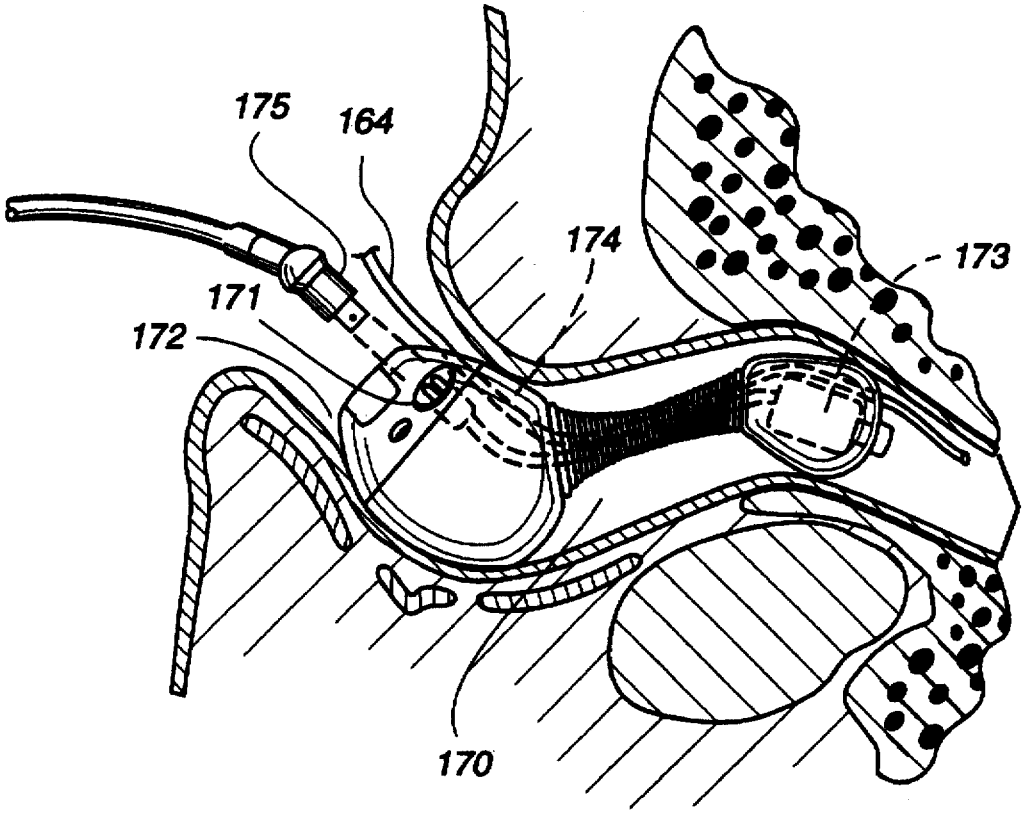
FIG. 31 shows an articulated intra-canal prosthesis in accordance with the invention.

An intra-canal prosthesis (ICP), disclosed in above referenced U.S. patent application Ser. No. 08/292,067, is adapted for articulation, as is shown in FIG. 31. The articulated ICP 170 is provided in the form of an articulated hearing device having a main module 172 that only contains an electrical connector 171 which routes electrical signals directly from a virtual electroacoustic audiometer (not shown), via a connector 175, to ICP receiver 173. A probe tube 164 is inserted in the ICP vent 174. The ICP probe tube 164 is used to measure the acoustic response in the ear canal near the tympanic membrane from acoustic signals generated via the ICP receiver 173. The ICP is generally used to perform intra-canal diagnostics and hearing aid simulation as disclosed in above referenced U.S. patent application Ser. Nos. 08/292,067 and 08/292,073. In this embodiment of the invention, the ICP is adapted to perform unaided, simulated aided hearing evaluation in accordance with virtual electroacoustic audiometry.

Figure 32:
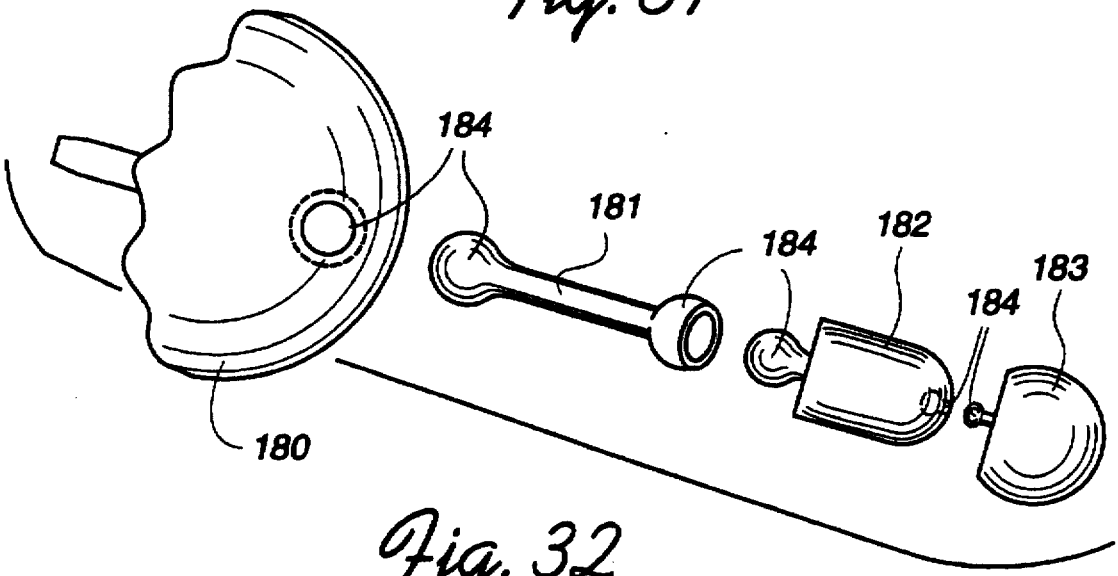
FIG. 32 is a partially exploded view showing sizers for an articulated hearing aid in accordance with the invention.

Sizers that represent the articulated hearing device in terms of physical characteristics, shown in FIG. 32, can be used to predetermine the optimal physical configuration of the hearing device for an individual prior to final device insertion. Sizers include main module sizers 180, connector sizers 181, receiver sizers 182, and seal tip sizers 183. The sizer parts are removably attached, preferably using snap-on connections 184, as shown. The main module sizer 180 may be directly attached to the receiver sizer 182 to represent hearing devices that have a very short connector. Other sizer shapes and articulation methods, representing the articulated hearing device of the present invention are possible and can be implemented by persons skilled in the art.

Although the invention is described herein with reference to the preferred embodiment, one skilled in the art will readily appreciate that other elements, materials, and applications may be substituted for those set forth herein without departing from the spirit and scope of the present invention. Accordingly, the invention should only be limited by the claims included below.

We claim:

1. A hearing device, comprising:

a main module adapted to contain any of a microphone, a battery, device controls, and a signal processing circuit;

a receiver module adapted to contain a receiver; and a connector adapted to provide an electrical connection between said main module and said receiver module;

wherein at least two of said main module, receiver module, and connector are connected by an articulating joint, such that said modules move freely and independently, one relative to the other within a range of movement and to freely maintain a position at any point within this range of movement, to permit independent movement of any of said main module and said receiver module in response to in situ ear canal deformation; and wherein said main module and said receiver module are each contained in separate, relatively rigid, non-resilient housings.

2. The hearing device of claim 1, wherein said main module is positioned in a medial concha area of said ear canal just behind the tragus.

3. The hearing device of claim 1, said main module further comprising:

a face-plate positioned either flush with or beyond an ear canal aperture.

4. The hearing device of claim 1, where main module controls are programmed into said main module.

5. The hearing device of claim 1, said receiver module further comprising:

an acoustic seal.

6. The hearing device of claim 5, wherein any or all of said main module, said receiver module, said connector, and said acoustic seal are provided in assorted, standard sizes.

7. The hearing device of claim 5, wherein any or all of said main module, said receiver module, said connector, and said acoustic seal are custom manufactured.

8. The hearing device of claim 5, said acoustic seal further comprising:

a soft and compliant material.

9. The hearing device of claim 5, said acoustic seal further comprising:

a soft and compliant bulbous ending.

10. The hearing device of claim 5, wherein said acoustic seal is made of any of a silicone material or a foam material.

11. The hearing device of claim 5, wherein said acoustic seal is either disposable, washable, or both.

12. The hearing device of claim 5, said acoustic seal further comprising:

a snap-on seal tip.

13. The hearing device of claim 5, said acoustic seal further comprising:

a threaded seal tip.

14. The hearing device of claim 5, said acoustic seal further comprising:

a tip that is articulated with respect to said receiver module.

15. The hearing device of claim 5, said acoustic seal further comprising:

at least one sealing ring.

16. The hearing device of claim 5, acoustic seal further comprising:

a removable sleeve.

17. The hearing device of claim 5, said acoustic seal further comprising:

a canal.

18. The hearing device of claim 5, wherein said acoustic seal is adapted for deep insertion into the individual's ear canal to minimize or eliminate occlusion effects.

19. The hearing device of claim 5, wherein said acoustic seal is coupled to said receiver to seal said ear canal and thereby prevent oscillatory feedback.

20. The hearing device claim 1, said connector further comprising:

a covering for reducing oscillatory feedback.

21. The hearing device of claim 1, said connector further comprising:

a covering having an absorbent layer for cerumen collection.

22. The hearing device of claim 1, wherein said articulation is achieved by at least one of:

a single point of articulation between said main module and said receiver module;

a single point of articulation between said receiver module and said connector;

a dual point of articulation at each end of said connector; and a flexible connector adapted to provide at least one point of articulation between said receiver module and said main module.

23. The hearing device of claim 1, further comprising:

means adapted to provide said articulation.

24. The hearing device of claim 23, wherein said articulation means comprise any of:

a ball joint;

a flexible joint; and a tapered boot.

25. The hearing device of claim 23, wherein said connector comprises any of:

a flexible connector;

a flexible connector having a relatively rigid center portion and comparatively flexible ends;

a flexible shaft having alternating grooves;

a spring coil; and a rigid connector.

26. The hearing device of claim 1, wherein said receiver module is adapted to be positioned in any one of:

the bony area of the ear canal; and the deeper cartilaginous area of the ear canal.

27. The hearing device of claim 1, wherein the diameter of either of said connector, said articulating joint, or said receiver module is less than the diameter of the individual's ear canal.

28. The hearing device of claim 1, wherein said connector is adapted to be positioned in the cartilaginous area of the ear canal.

29. The hearing device of claim 1, wherein said connector is adjustable to accommodate a variety of individual ear canal lengths, and to permit receiver placement at a selected depth in the ear canal.

30. The hearing device of claim 1, further comprising:

means for adjusting the length of said connector length, said adjusting means comprising at least one of:

a turnbuckle shaft; and a telescoping shaft.

31. The hearing device of claim 1, further comprising:

a plurality of modular, differently dimensioned, detachable sizers, said sizers being adapted to determine at least optimal hearing device size, patient comfort, hearing device ear canal insertion depth tolerance, ease of ear canal insertion and removal, appearance, and overall hearing device physical characteristics.

32. The hearing device of claim 1, said main module further comprising:

a vent adapted to receive a probe tube.

33. The hearing device of claim 1, said main module further comprising:

at least one vent adapted to vent the patient's ear canal to thereby reduce occlusion effect and improve air circulation.

34. The hearing device of claim 1, said receiver module further comprising:

a canal adapted to receive a probe tube.

35. The hearing device of claim 1, said receiver module further comprising:

a canal adapted to provide pressure relief.

36. The hearing device of claim 1, said main module including a microphone, wherein said microphone is adapted to receive direct acoustic input from a receiver in accordance with virtual electroacoustic audiometry.

37. The hearing device of claim 1, wherein said receiver module is adapted for deep insertion into the patient's ear canal to minimize or eliminate occlusion effects.

38. The hearing device of claim 1, said connector further comprising:

means for reducing vibration-caused oscillatory feedback.

39. The hearing device of claim 38, wherein said means for reducing vibration-caused oscillatory feedback are made of a viscoelastic material.

40. The hearing device of claim 1, said connector further comprising:

means for reducing piston action caused oscillatory feedback.

41. The hearing device of claim 40, wherein said means for reducing piston action caused oscillatory feedback are made of a viscoelastic material.

42. The hearing device of claim 1, wherein said receiver module and said main module are acoustically and/or vibrationally isolated from each other.

43. The hearing device of claim 1, further comprising:

an acoustic seal that is adapted to be positioned in any one of:

the bony area of the ear canal; or the deeper cartilaginous area of the ear canal.

44. The hearing device of claim 1, wherein said main module and said receiver module are contained in, or associated with, separate, non-contiguous housings.

45. An intra-canal prosthesis (ICP) that is representative of a hearing aid prostheses, said ICP being adapted to perform unaided, simulated aided hearing evaluation in accordance with virtual electroacoustic audiometry, said ICP comprising:

a main module adapted to provide an electrical connection to a virtual electroacoustic audiometer;

a receiver module adapted to contain a receiver; and a connector adapted to provide an electrical connection between said main module and said receiver module;

wherein at least two of said main module, receiver module, and connector are connected by an articulating joint, such that said modules move freely and independently, one relative to the other within a range of movement and to freely maintain a position at any point within this range of movement, to permit independent movement of any of said main module, said receiver module, and said connector in response to in situ ear canal deformation; and wherein said main module and said receiver module are each contained in separate, relatively rigid, non-resilient housings.

46. A hearing device, comprising:

a main module comprising any of a microphone, a battery, device controls, and a signal processing circuit;

a receiver module comprising a receiver; and a connector for providing an electrical connection between said main module and said receiver module;

wherein at least two of said main module, receiver module, and connector are connected by an articulating joint, such that said modules move freely and independently, one relative to the other within a range of movement and to freely maintain a position at any point within this range of movement, to permit independent movement of any of said main module, said receiver module, and said connector in response to in situ ear canal deformation; and wherein said main module and said receiver module are each contained in separate, relatively rigid, non-resilient housings.

* * * * *